US009114306B2

(12) United States Patent
Vailli

(10) Patent No.: US 9,114,306 B2
(45) Date of Patent: Aug. 25, 2015

(54) BRAKING DEVICE FOR ALPINE TOURING SKI

(71) Applicant: Skis Rossignol, Saint-Jean-de-Moirans (FR)

(72) Inventor: Johan Vailli, Coublevie (FR)

(73) Assignee: SKIS ROSSIGNOL, Saint-Jean-de-Moirans (FR)

( * ) Notice: Subject to any disclaimer, the term of this patent is extended or adjusted under 35 U.S.C. 154(b) by 0 days.

(21) Appl. No.: 14/101,599

(22) Filed: Dec. 10, 2013

(65) Prior Publication Data

US 2014/0159343 A1 Jun. 12, 2014

(30) Foreign Application Priority Data

Dec. 10, 2012 (FR) ..... 12 61824

(51) Int. Cl.
*A63C 7/10* (2006.01)
*A63C 9/08* (2012.01)

(52) U.S. Cl.
CPC ..... *A63C 7/1073* (2013.01); *A63C 7/1033* (2013.01); *A63C 9/0807* (2013.01)

(58) Field of Classification Search
USPC ..... 280/614, 615, 617, 616, 604
See application file for complete search history.

(56) References Cited

U.S. PATENT DOCUMENTS

| | | | | | |
|---|---|---|---|---|---|
| 4,062,553 | A | * | 12/1977 | Riedel | 280/604 |
| 4,231,584 | A | * | 11/1980 | Kikuchi | 280/604 |
| 4,268,060 | A | * | 5/1981 | Svoboda | 280/605 |
| 4,272,099 | A | * | 6/1981 | Svoboda et al. | 280/605 |
| 4,294,459 | A | * | 10/1981 | Svoboda et al. | 280/605 |
| 4,333,667 | A | * | 6/1982 | Leichtfried et al. | 280/605 |
| 4,483,551 | A | * | 11/1984 | Beyl et al. | 280/605 |
| 4,498,685 | A | * | 2/1985 | Zoor | 280/605 |
| 4,505,493 | A | * | 3/1985 | Gustavsson | 280/617 |
| 4,515,388 | A | * | 5/1985 | Emert et al. | 280/605 |
| 4,676,520 | A | * | 6/1987 | Gasquet et al. | 280/605 |
| 4,687,221 | A | * | 8/1987 | Salomon | 280/605 |
| RE32,567 | E | * | 12/1987 | Emert et al. | 280/605 |
| 4,763,918 | A | * | 8/1988 | Sedlmair | 280/605 |
| 5,002,303 | A | * | 3/1991 | Freisinger et al. | 280/605 |
| 5,318,321 | A | * | 6/1994 | Dogat et al. | 280/633 |
| 6,073,955 | A | * | 6/2000 | Chonier | 280/605 |
| 6,293,576 | B1 | * | 9/2001 | Hunter | 280/604 |
| 6,390,491 | B1 | * | 5/2002 | Hunter | 280/604 |

(Continued)

FOREIGN PATENT DOCUMENTS

| | | |
|---|---|---|
| DE | 24 10 297 A | 9/1975 |
| DE | 25 25 945 A | 12/1976 |
| FR | 2 541 124 A | 8/1984 |

OTHER PUBLICATIONS

Search Report issued by French Patent Office for priority application, FR1261824 and dated Sep. 4, 2013.

*Primary Examiner* — Jeffrey J Restifo
(74) *Attorney, Agent, or Firm* — Frommer Lawrence & Haug LLP

(57) ABSTRACT

Braking device for a touring ski comprising a brake (1) and a blocking device able to occupy a blocking configuration in which the brake (1) is immobilized by the blocking device in the position of non-braking and a non-blocking configuration in which the brake is able to brake the ski in a braking position, characterized in that the blocking device is mounted with the ability to move in sliding with respect to the brake (1) so as to occupy the blocking configuration or non-blocking configuration.

26 Claims, 6 Drawing Sheets

(56) References Cited

U.S. PATENT DOCUMENTS

| | | | | |
|---|---|---|---|---|
| 6,722,687 | B2 * | 4/2004 | Hunter | 280/605 |
| 7,422,227 | B2 * | 9/2008 | Riedel et al. | 280/605 |
| 7,819,418 | B2 * | 10/2010 | Buquet et al. | 280/605 |
| 2006/0279068 | A1 * | 12/2006 | Buquet et al. | 280/605 |
| 2007/0152426 | A1 * | 7/2007 | Resch et al. | 280/604 |
| 2013/0062861 | A1 * | 3/2013 | Desarmaux et al. | 280/605 |
| 2013/0181427 | A1 * | 7/2013 | Fritschi | 280/614 |
| 2014/0070519 | A1 * | 3/2014 | Fritschi et al. | 280/623 |
| 2014/0159343 | A1 * | 6/2014 | Vailli | 280/604 |

* cited by examiner

BRAKING DEVICE FOR ALPINE TOURING SKI

The invention relates to a braking device for a gliding board, particularly suited to alpine touring skis. It also relates to a binding for attaching a boot to a gliding board, such as a heelpiece or a toepiece, incorporating such a braking device. It also finally relates to a ski to which such a braking device is attached.

Alpine touring skiing requires two different phases of operation of the ski. In a first, climbing, phase, or more generally walking phase, the skier moves forward by lifting his heel, which is not secured to the gliding board. In this first phase, no ski braking device is used. In a second, decent, phase, the skier has his ski boot completely secured to the ski, and skis just as in alpine skiing. He therefore needs a binding equipped with a trigger mechanism that allows the boot to be released automatically in the event of a fall, to avoid any injury and thus keep him safe. A braking device is therefore also essential to automatically brake the ski if the binding release mechanism is triggered, to prevent the ski from continuing to slide.

In order to meet the above requirements, the braking device of the alpine touring ski is generally fitted with a blocking device which allows it to be blocked and disabled during the first phase of climbing. During the decent, the blocking device is in an unblocked configuration in which the brake works in a similar way to the brakes with which alpine skis are fitted.

However, the existing solutions remain unsatisfactory and it is an object of the present invention to propose a braking device for alpine touring skiing which is simple, user-friendly and reliable.

To this end, the invention relies on a braking device for a touring ski comprising a brake, provided with an elastic element which applies an elastic return force returning braking branches to the braking position of the brake, and a blocking device able to occupy a blocking configuration in which the brake is immobilized by the blocking device in the position of non-braking and a non-blocking configuration in which the brake is able to brake the ski in a braking position, characterized in that the blocking device is mounted with the ability to move in sliding with respect to the brake so as to occupy the blocking configuration or non-blocking configuration, and in that the blocking device comprises a blocking element which acts on the brake during actuation of the blocking device by applying a first effect of positioning the brake in the non-braking position which opposes the elastic return force.

The blocking element may act directly on the elastic element of the brake during actuation of the blocking device, irrespective of the initial position of the brake, applying a dynamic effect of positioning the brake in the non-braking position as the blocking device moves towards the blocking configuration.

The invention also relates to a braking device for a touring ski comprising a brake and a blocking device able to occupy a blocking configuration in which the brake is immobilized by the blocking device in the position of non-braking and a non-blocking configuration in which the brake is able to brake the ski in a braking position, characterized in that the blocking device is mounted with the ability to move in sliding with respect to the brake so as to occupy the blocking configuration or non-blocking configuration, and in that the blocking device comprises an attachment element for a heelpiece of a ski binding to allow the heelpiece to move back automatically as the blocking device passes into the brake blocking configuration.

The blocking device may be independent of the brake.

The brake may be fixed to a ski and the blocking device may be able to slide with respect to the brake.

The invention also relates to a heelpiece and braking device assembly for attaching the rear part of a ski boot to a touring ski, characterized in that the heelpiece is connected to a braking device as described hereinabove.

In this heelpiece/braking device assembly, the heelpiece may be connected to the blocking device in order to achieve automatic backward movement of the heelpiece as the braking device passes towards its brake blocking configuration.

The invention also relates to an alpine touring ski, characterized in that it comprises a braking device as described hereinabove and/or a heelpiece/braking device assembly as described hereinabove.

The invention is defined in greater detail by the claims.

These objects, features and advantages of the present invention will be set out in detail in the following description of some particular embodiments given nonlimitingly with reference to the attached figures in which.

Figure 1:
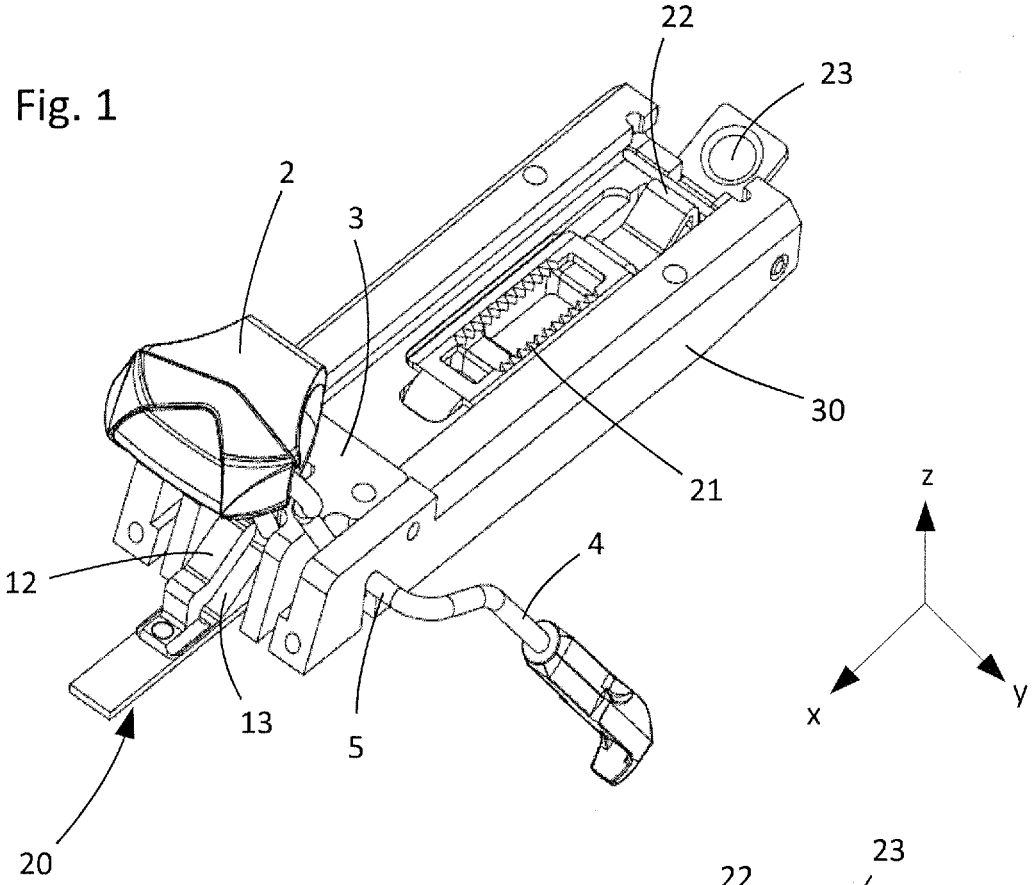
FIG. 1 depicts a perspective view of a braking device in the unblocked configuration, referred to hereinafter as the non-blocking configuration, and in the braking position, according to a first embodiment of the invention.
Figure 2:
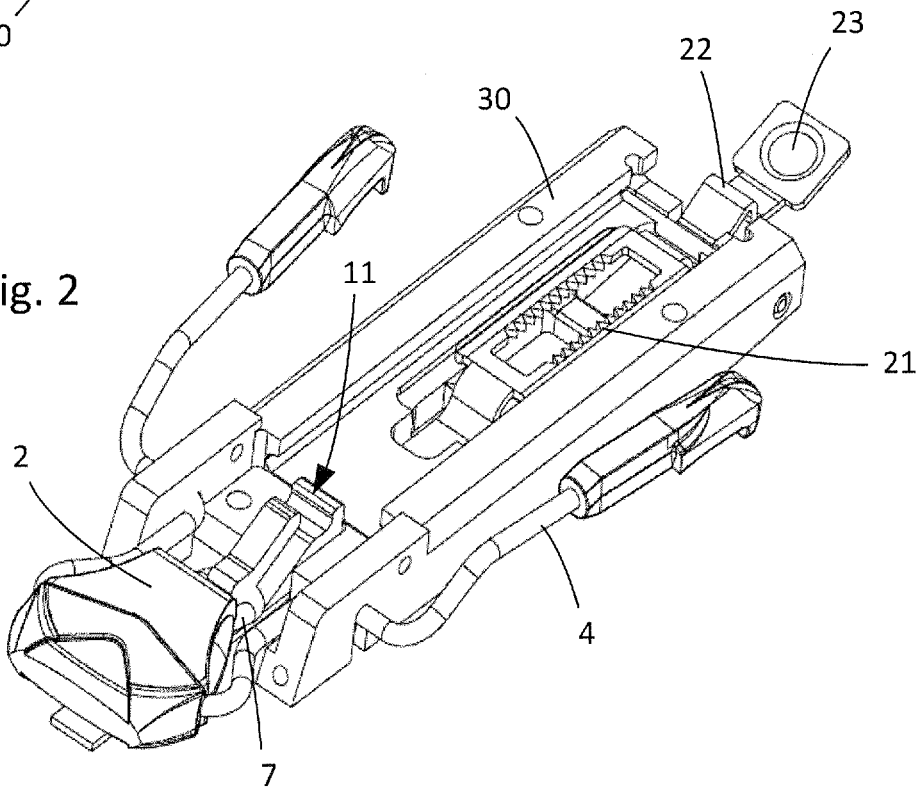
FIG. 2 depicts a perspective view of the braking device in the blocked configuration, referred to hereinafter as the blocking configuration, according to the first embodiment of the invention.

To make the remainder of the description easier to understand we shall define the longitudinal direction x as being the horizontal direction stretching from the rear of the ski forwards, the transverse direction y as the horizontal direction perpendicular to the direction x, and the vertical direction z as perpendicular to the horizontal plane defined by the axes x and y, directed upwards. Furthermore, the same references are used for the same or roughly the same elements in both of the embodiments described hereinbelow. Elements which differ in terms of their structure but which perform the same function are given the same reference numeral with the "'" symbol added for the second embodiment.

Figure 3:
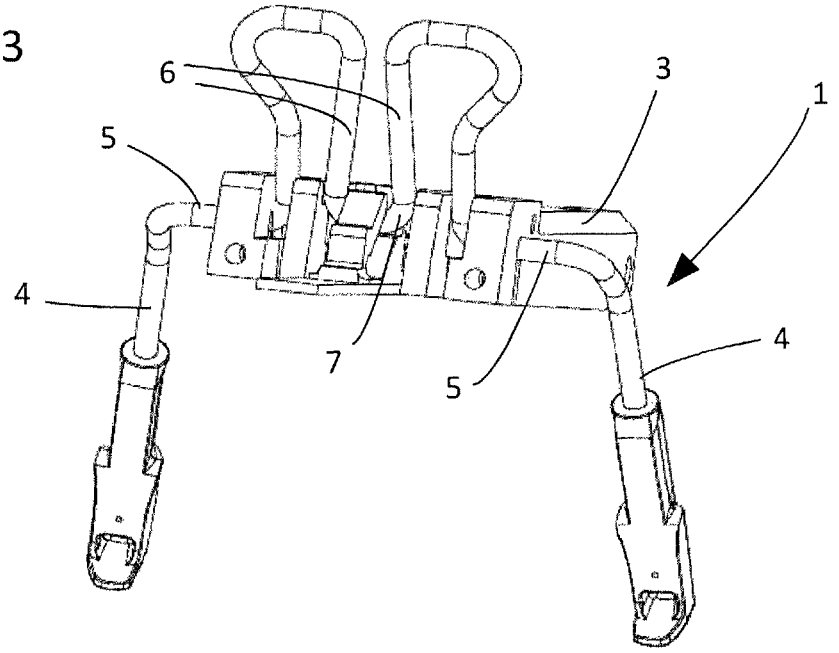
FIG. 3 depicts a simplified perspective view of the braking device in the braking position according to the first embodiment of the invention.
Figure 4:
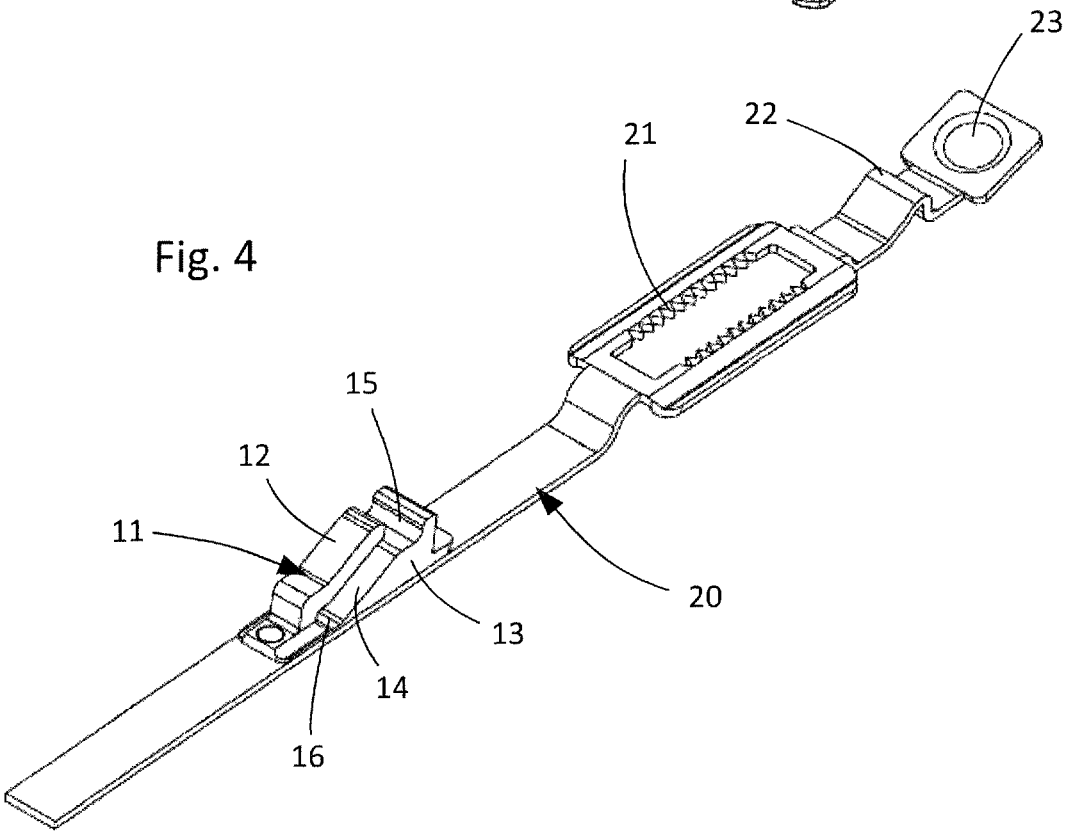
FIG. 4 depicts a perspective view of the blocking device according to the first embodiment of the invention.

FIGS. 1 to 7 therefore depict a braking device according to a first embodiment, which comprises a brake 1, more particularly visible in FIG. 3, and a blocking device, more particularly visible in FIG. 4. This embodiment is intended for combining the braking device with a heelpiece of a ski binding, for example of the kind used for alpine skiing. Note that to make the figures easier to understand, the ski boot, the binding for this boot (the heelpiece) and the ski itself have not been depicted in these figures.

The brake 1 visible in FIG. 3 is a conventional brake used on an alpine ski, depicted in the braking position, as described for example in document FR2788991. It comprises a pedal 2 on which a ski boot, generally the heel of the boot, is intended to press in order to pivot it from the first, braking, position into a non-braking position, as depicted for example in FIGS. 1 and 2 respectively, for skiing. This brake additionally comprises a heel rest 3 intended for attachment more or less to the surface of the ski and to accept the sole of the ski boot during the decent, when it is attached by the jaws of a heelpiece and the brake is in a non-braking position. Next, the brake 1 comprises a continuous metallic element forming two braking branches 4 in the bottom part, which are intended to sit one on either side of the ski. In the braking position, these braking branches 4 extend downwards below the underside of the ski to rub against the snow and brake the ski. These branches are then extended by two substantially horizontal parts 5 which pass through an opening in the heel rest and possibly in the base 30 which rests on the ski. These horizontal parts thus form a transverse axis of rotation of the metallic element with respect to the heel rest of the brake. The metallic element then extends upwards as far as the pedal 2, where it forms a continuous central bow 6 which drops back down under the pedal and the U-shaped lower end 7 of which lies substantially level with the heel rest 3. This shape of metallic element, and more particularly the bow 6, gives it elasticity. The bow 6 constitutes the return spring of the brake.

At rest, the brake 1 is in the braking position as depicted in FIGS. 1 and 3. When a skier puts the ski on, the force of his boot pressing down on the pedal 2 forces the entire metallic element to rotate about its parts 5 that form a transverse axis of rotation, until the pedal 2 comes close to the surface of the ski and the boot is resting on the heel rest. In this final position referred to as the non-braking position, the two braking branches 4 are in a substantially horizontal raised position and can no longer come into contact with the snow and do not impede normal skiing. If the skier falls and his boot is released by the release mechanism of the ski boot binding, the boot no longer presses down on the brake which then automatically elastically returns to its braking position in order to halt the ski.

The braking device additionally comprises a blocking device the function of which is to block the brake 1 in what is referred to as the blocking configuration during a climbing phase when the ski is being used for alpine ski touring. The blocking device comprises a blocking element 11 arranged towards a front end of a link rod 20 mounted with the ability to slide in a substantially longitudinal direction within a base 30 intended for attachment to the surface of the ski, near the brake. This base 30 is lodged on either side of the heel rest 3 of the brake, at its forward part where it forms an additional lateral retention for the braking branches 4. In this embodiment, sliding of the link rod causes it to move in longitudinal translation, in both directions, so that it can bring about the two configurations of the blocking device and therefore of the braking device.

The blocking device is more particularly visible in FIG. 4. The blocking element 11 comprises two elements, upper 12 and lower 13, delimiting a groove 14 intended to collaborate with the lower part 7 of the bow 6 of the brake. The lower element 13 comprises an upper first substantially horizontal surface 15, then a surface that is inclined towards the ski, forming a guide ramp for inserting the brake into the groove 14, as will be explained later on. Finally, it forms a lower second substantially horizontal surface 16. This blocking element 11 is therefore arranged on a link rod 20, which then comprises toward the rear a taller part bearing a toothset 21 or notching, then a bow 22 before ending at its rear end in the form of an actuating element 23 that forms a substantially concave surface with a diameter suited to accepting the tip of a ski stick.

Figure 5:
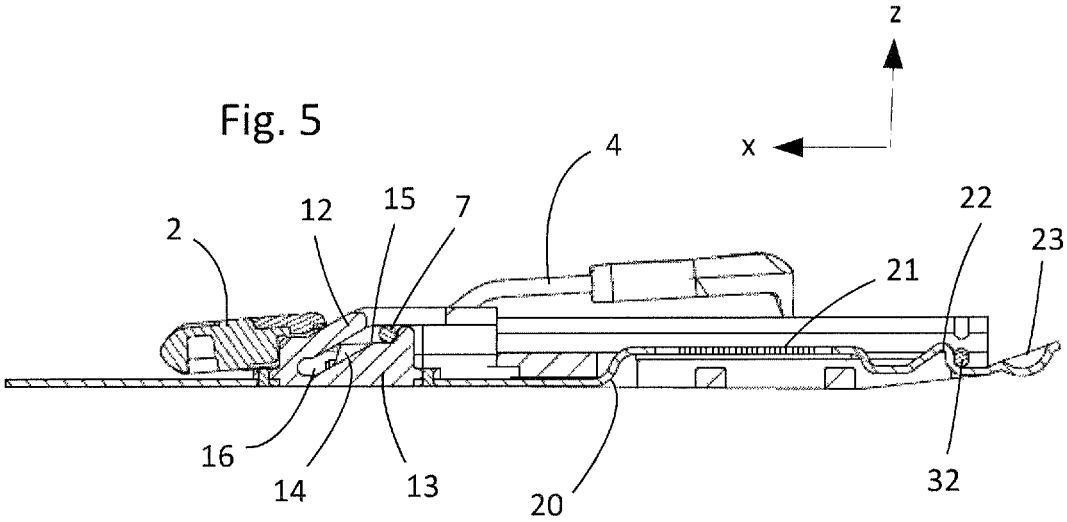
FIG. 5 depicts a view in cross section on a longitudinal median plane of the braking device in the non-blocking configuration and in the non-braking position according to the first embodiment of the invention.
Figure 6:
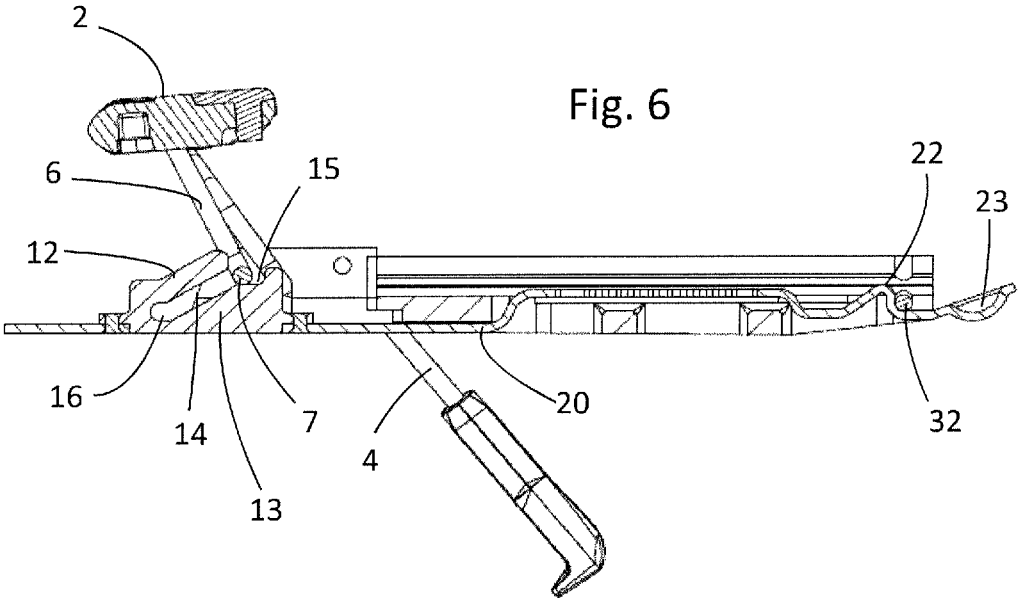
FIG. 6 depicts a view in section on a longitudinal median plane of the braking device in the non-blocking configuration and in the braking position according to the first embodiment of the invention.
Figure 7:
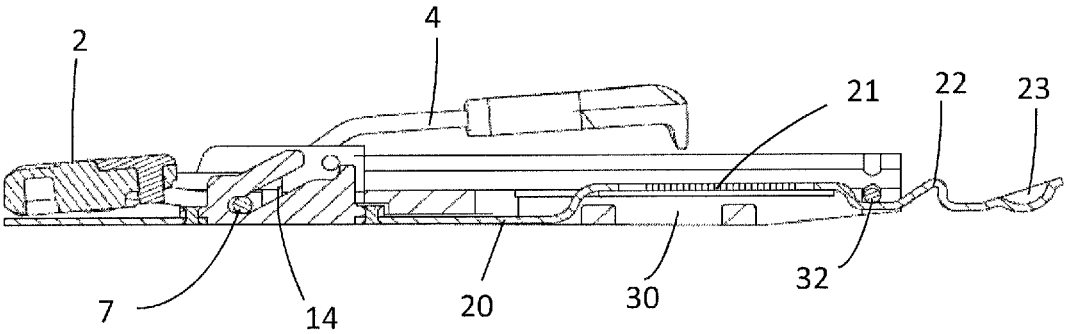
FIG. 7 depicts a view in cross section on a longitudinal median plane of the braking device in the blocking configuration according to the first embodiment of the invention.
Figure 8:
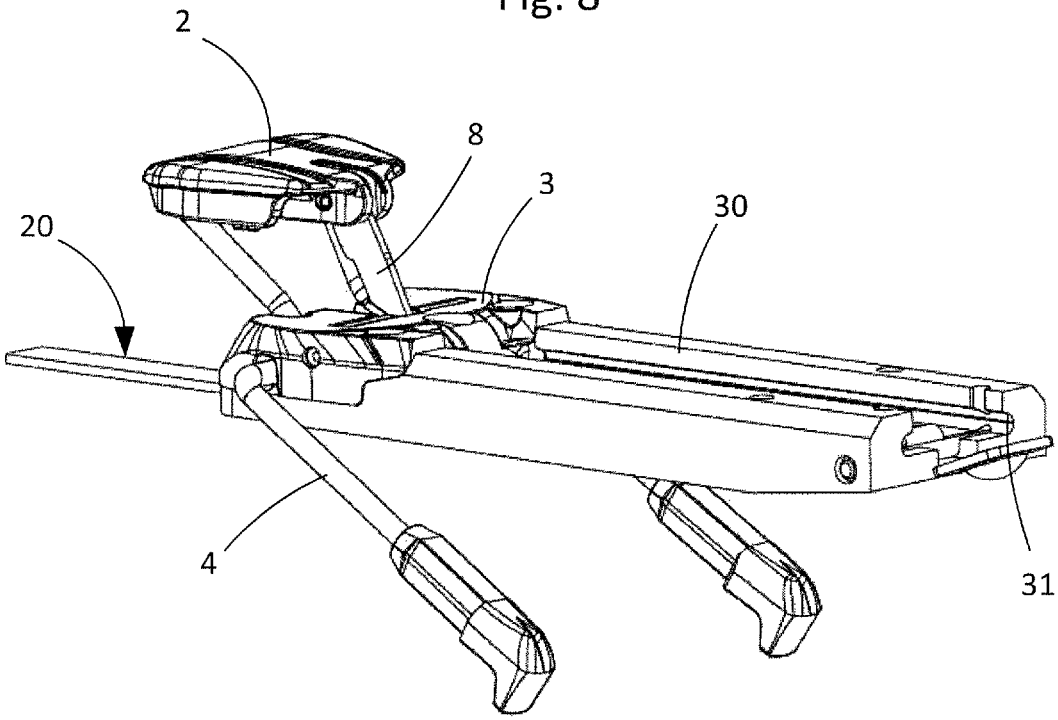
FIG. 8 depicts a perspective view of a braking device in the non-blocking configuration and in the braking position according to a second embodiment of the invention.
Figure 9:
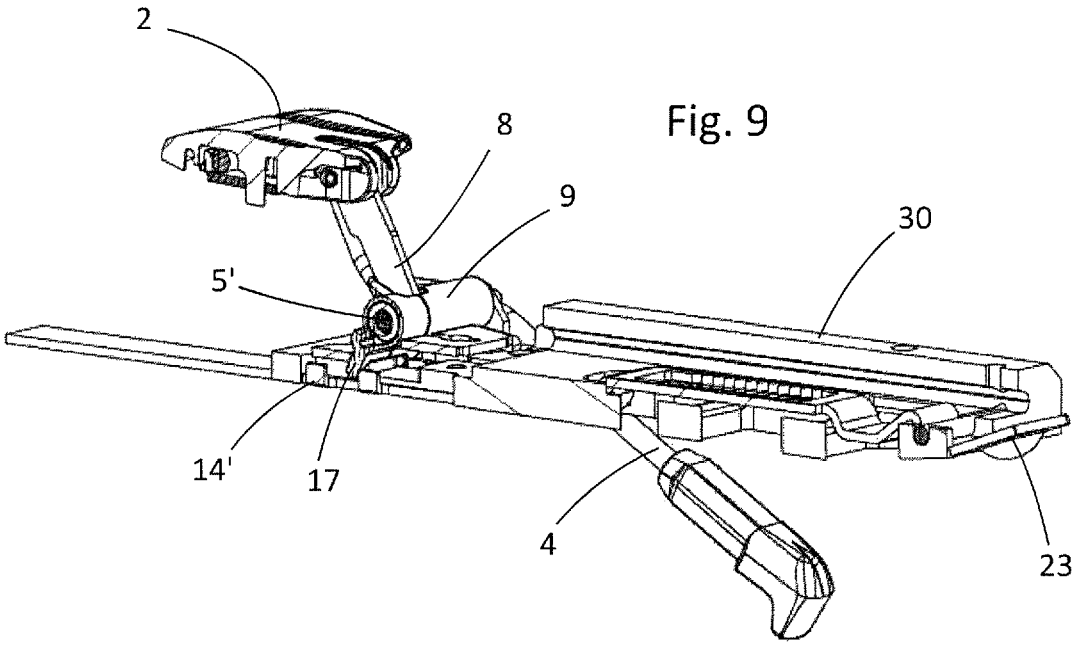
FIG. 9 depicts a view in cross section on a longitudinal median plane of the braking device in non-blocking configuration and in the braking position according to the second embodiment of the invention.

FIGS. 5 to 7 more specifically illustrate how the braking device according to this first embodiment works.

In FIGS. 5 and 6, this braking device is in a non-blocking configuration. There can therefore be seen the lower part 7 of the metallic element of the brake, more specifically of the spring-forming bow 6, which presses against the first substantially horizontal surface 15 arranged at the upper part of the groove 14 of the blocking element 11. In this configuration, the brake is free to rotate with respect to the ski to occupy the non-braking position illustrated in FIG. 5, or the braking position illustrated in FIG. 6, according to whether or not a ski boot is in position on the ski. Note that it can be seen that the lower end 7 of the bow 6 shifts along the surface 15 slightly between these two positions.

In the configuration of non-blocking of the braking device, only the end forming the actuating element 23 of the link rod 20 protrudes beyond the rear of the base 30 of the ski boot binding. The bow 22 of the link rod presses against a transverse rod 32 arranged in the base 30, preventing any accidental rearward movement of the link rod 20. This collaboration of the bow 22 of the link rod with the transverse rod 32 of the base 30 of the ski forms a device that locks the link rod 20.

The passage of the braking device from this first configuration of non-blocking to the blocking configuration is brought about by manual pressure on the surface of the actuating element 23 of the link rod 20, for example in a user-friendly manner using the tip of a stick, to generate an elastic lever effect on the rear part of the link rod 20 that allows its bow 22 to pass under the rod 32 while at the same time introducing a rearward thrusting effect on the link rod, causing it to slide backwards within the base 30 as soon as it is unlocked. Thereafter, this sliding movement continues until an end stop is reached in which position the lower end 7 of the bow 6 of the brake is on the second horizontal surface 16 at the bottom part of the groove 14 of the blocking element. In this position, which is depicted in FIG. 7, the bow 6 loses any degree of freedom and this then blocks the brake in its non-braking position. The blocking element 11 opposes the elastic return of the brake. Because it acts directly on the bow 6 of the metal element, which forms the energizing component that produces the spring effect of the brake, this opposing effect works even better.

Note, the shape of the rear part of the link rod allows it to remain pressing elastically under the rod 32 at a lower part of the link rod. This geometry prevents any accidental sliding of the link rod and this blocking configuration is stable.

The link rod 20 can be actuated while the brake is in the braking position. The first effect of this is to cause the brake to pass into the non-braking position, after which it is then blocked in this position. Thus, the blocking element of the blocking device acts directly on the spring element of the brake while the blocking device is being actuated, irrespective of the initial position of the brake, and this allows it first of all to apply a first dynamic effect of correctly positioning the brake as the blocking device gradually moves, then a second static effect of blocking the brake in the non-braking position at the end of the movement.

As was seen above, the link rod 20 also comprises a toothset 21. The function of this toothset is to allow a heelpiece of a ski binding to catch via a corresponding toothset arranged under its underside. The use of the toothsets allows longitudinally adjustable positioning of the heelpiece. For this purpose the latter advantageously comprises rails which collaborate with guide ways 31 arranged on the lateral part of the base 30, allowing it to slide longitudinally along these guide ways 31. When its longitudinal position corresponds to the size of the boot, the heelpiece is then engaged in the toothset 21 of the link rod to secure it to the ski via this link rod 20. This arrangement advantageously allows the link rod 20 to perform a second function, in addition to its function of blocking the brake as explained hereinabove, and namely that of moving the heelpiece back during the passage into the blocking configuration. Indeed as was explained earlier, during this transition, the link rod is slid backwards. It therefore carries with it the heelpiece which moves as one with it in this rearward movement. That allows the heelpiece to be moved away from the boot in the configuration of blocking the braking device, which is the configuration used for the climbing phase in alpine ski touring, during which phase the heel of the boot is not secured to the ski but free. The rearward movement of the heelpiece then frees up some volume so that the movement of the heel of the boot is not impeded during the climb phase.

Conversely, when the configuration of the braking device is changed to the non-blocking configuration, the link rod returns to its forward position and the heelpiece then adopts the same position as it had before. It thus returns automatically to the correct position without the need for a new setting of shoe size, and this is very user-friendly and advantageous.

The profile of the groove 14 of the blocking element determines the length of sliding of the link rod and therefore the rearward movement of the heelpiece between the two configurations of the braking device. Advantageously, a rearward movement of at least 20 mm is applied.

Naturally, the concept has been described nonlimitingly hereinabove in an embodiment associated with a particular brake. However, the invention can easily be transferred across to any other configuration.

Figure 10:
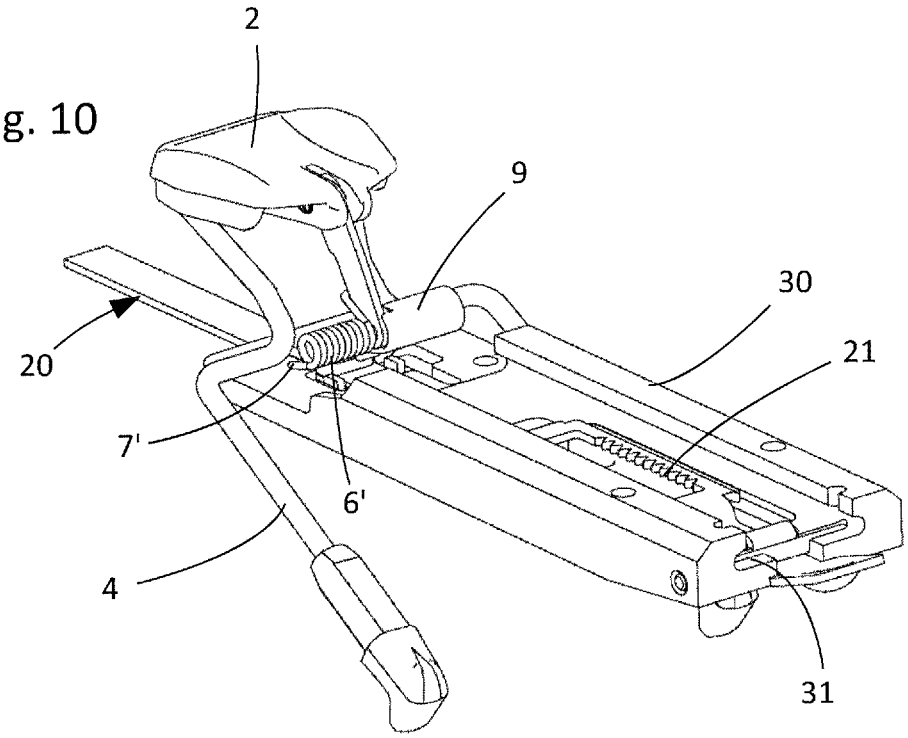
FIGS. 10 and 11 depict perspective views with parts removed of the braking device in the non-blocking configuration and in the braking position according to the second embodiment of the invention.
Figure 11:
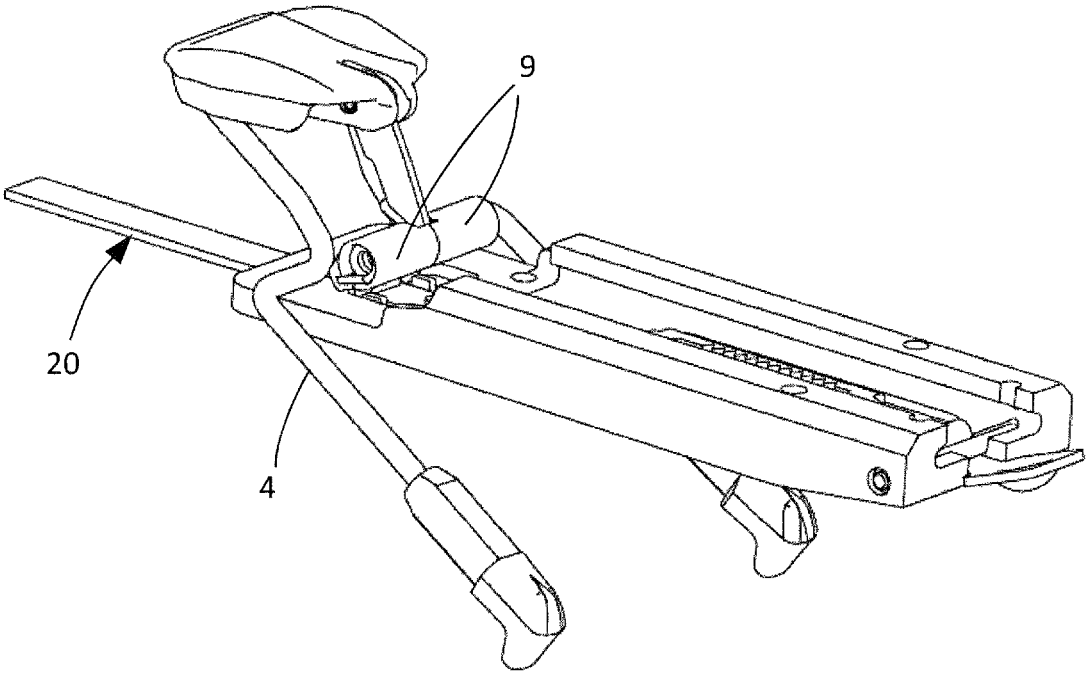
Figure 12:
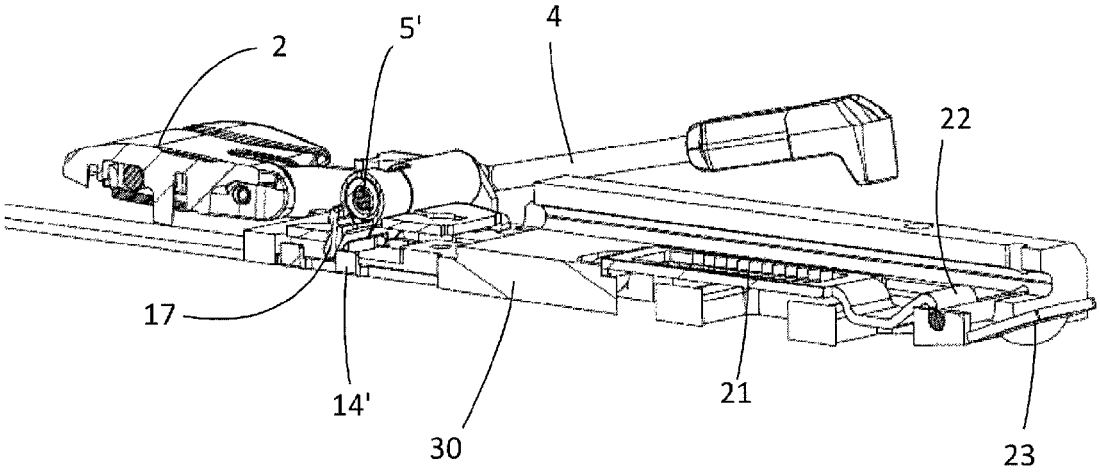
FIG. 12 depicts a view in cross section on a longitudinal median plane of the braking device in the non-blocking configuration and in the non-braking position according to the second embodiment of the invention.
Figure 13:
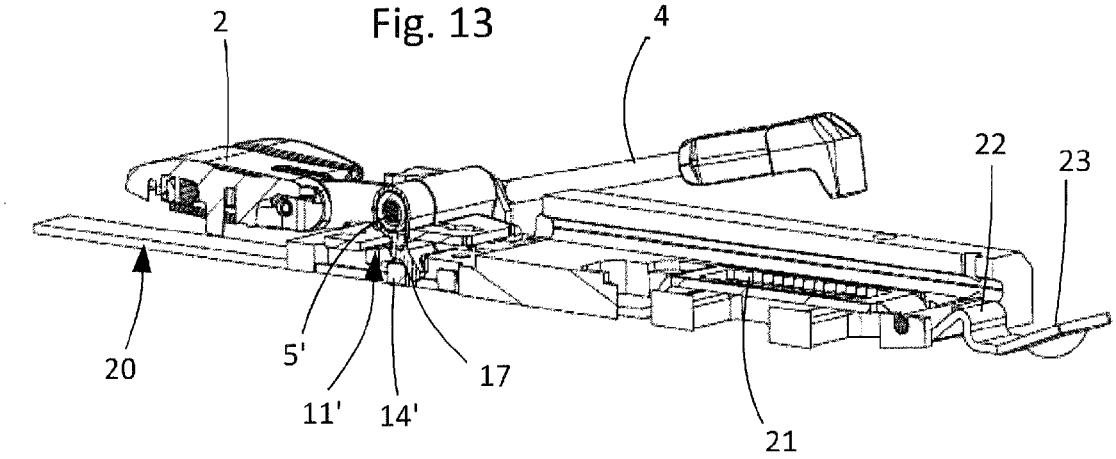
FIG. 13 depicts a view in cross section on a longitudinal median plane of the braking device in the blocking configuration according to the second embodiment of the invention.

FIGS. 8 to 13 thus by way of example depict a second embodiment in which the brake has a different architecture, likewise one that already exists in the prior art, for example as described by document U.S. Pat. No. 4,515,388. This brake differs from the previous one in that it no longer rests on a single continuous metallic element. By contrast, the pedal 2 is mounted with the ability to move about a transverse axis 5' near the surface of a ski via a connecting rod 8. The return spring effect is performed by an elastic element or torsional spring 6'. The latter is in two parts connected about a central part that forms a blade in contact with the connecting rod 8. It is arranged around the axis of rotation 5' and acts on the connecting rod 8 via the central part thereof so as to transmit to it a return force that returns the pedal towards its raised position, and thus returns the braking device towards the braking position of the brake. The two braking branches 4 are separate and are connected to the pedal 2 by two distinct respective metal rods. They are independent of the spring 6'. FIG. 10 shows part of the spring 6' without its cylindrical cowling 9 to make the figure easier to understand. In this embodiment, the base 30 is extended in its forward part under the heel rest 3 and forms a lateral support for the braking branches 4.

The blocking device of this second embodiment also relies on a link rod 20 the rear part of which is similar to that of the first embodiment, but differs through the use of a different blocking element which takes the form of a simple stop piece 14'. The spring 6' of the braking device comprises two lateral ends 7', oriented downwards, which can collaborate with two respective lateral tabs 17 of the cowling 9, which tabs can themselves collaborate with stop pieces 14' of the blocking device, as will be detailed hereinafter.

FIGS. 8 to 12 depict the non-blocking configuration. The link rod occupies its forward position, in which only the actuating element 23 is positioned above the base 30. In this position, the brake is free to rotate, according to the actuation of the pedal 2, so that the brake can occupy the position of non-braking illustrated by FIG. 12, or the braking position illustrated by FIGS. 8 to 11.

When the link rod 20 has moved back, as explained earlier, two lateral stop pieces 14' come to rest respectively against the tabs 17 which act on the lateral ends 7' of the spring 6' so that this spring 6' acts on the connecting rod 8 of the brake, to force the brake into its non-braking position and keep it in this non-braking position. The stop piece 14' therefore directly opposes the return force applied by the return spring 6' arranged about the axis of rotation 5' of the brake, via the cowling, and the resultant braking device operation is therefore similar to that described hereinabove. Naturally, in these embodiments, the fact that blocking is applied directly to the elastic element has the advantage of highly effective blocking. This direct blocking is to be understood therefore in the broadest sense, potentially via one or more intermediate components, such as a cowling. As in the previous embodiment, the blocking element of the blocking device therefore acts directly on the spring element of the brake when the blocking device is actuated, whatever the initial position of the brake, and this allows it first of all to apply a first dynamic effect of correctly positioning the brake as the blocking device gradually moves then a second static effect of the blocking the brake in the non-braking position at the end of the movement.

Naturally, other embodiments are conceivable without departing from the scope of the present invention.

For example, simplified embodiments can be obtained by eliminating the backward movement function associated with the blocking function. When this is done, the link rod used can be simplified, by omitting the toothed part 21 thereof. As an alternative, this link rod may extend forward or sideways and be actuated differently. In particular, it may be connected to the toepiece intended to secure the front end of a ski boot, and be actuatable using a lever or some member positioned towards the front of this toepiece. In an even further simplified way, the blocking element is independent, not necessarily connected to a link rod but, for example, to a simple base mounted with the ability to slide relative to the brake, and therefore relative to the ski. The blocking element is therefore an element separate from the brake according to one embodiment. The heel rest of the brake is preferably mounted fixedly on the ski. It may coincide with the base mentioned earlier.

As an alternative, the rearward movement function may be maintained, but the connection between the link rod and the heelpiece may be simplified, may rely on any attachment element which does not necessarily offer longitudinal adjustment of the heelpiece.

In addition, the blocking device is independent of the brake. The heel rest or base of the latter is advantageously fixed to the ski, and the independent blocking element is able to move in sliding with respect to the mobile part of the brake that is to be blocked, so that it can interact with it or otherwise.

The blocking element can preferably be actuated in a simple and user-friendly way, manually, potentially using a ski stick, but without the need for a tool.

Any device for locking the blocking element may be provided to stabilize one or both of the configurations of the braking device. In a simplified alternative form, no locking device is used.

The braking device has been advantageously combined with a heelpiece of a ski boot binding of the kind of heelpiece used for alpine skiing. As an alternative, the principle is still compatible with any other heelpiece. It may also be combined with a toepiece of a ski binding, intended to attach the front of a boot, rather than a heelpiece, or may be independent of both of these bindings, toepiece and heelpiece, and for example placed on the ski between these two bindings.

The invention claimed is:

1. Braking device for a touring ski comprising a brake, provided with an elastic element which applies an elastic return force returning braking branches to the braking position of the brake, and a blocking device able to occupy a blocking configuration in which the brake is immobilized by the blocking device in the position of non-braking and a non-blocking configuration in which the brake is able to brake the ski in a braking position, wherein the blocking device is mounted with the ability to move in sliding with respect to the brake so as to occupy the blocking configuration or non-blocking configuration, and wherein the blocking device comprises:

a link rod comprising a blocking element able to block the brake;

an actuating element for sliding the link rod and the blocking element, and a blocking element which acts on the brake during actuation of the blocking device by applying a first effect of positioning the brake in the non-braking position which opposes the elastic return force.

2. Braking device for a touring ski according to the claim 1, wherein the blocking element of the blocking device acts directly on the elastic element of the brake during actuation of the blocking device, irrespective of the initial position of the brake, applying a dynamic effect of positioning the brake in the non-braking position as the blocking device moves towards the blocking configuration.

3. Braking device according to claim 1, wherein the blocking device is independent of the brake.

4. Braking device according to claim 1, wherein the brake is fixed to a ski and in that the blocking device is able to slide with respect to the brake.

5. Braking device according to claim 1, wherein the blocking element acts directly on the elastic element of the brake during actuation of the blocking device and/or when the braking device is occupying its blocking configuration.

6. Braking device according to claim 1, wherein the blocking device comprises a blocking element which comprises a groove that allows the brake to be blocked.

7. Braking device according to claim 1, wherein the blocking device comprises a blocking element which comprises a stop piece that allows the brake to be blocked.

8. Braking device according to claim 1, wherein the link rod comprises a bow for locking the blocking device in the non-blocking configuration, unlocking being obtained through a lever-type elastic effect of the link rod by applying a force to the actuating element.

9. Braking device according to claim 1, wherein the blocking device comprises an attachment element for a heelpiece of a ski binding to allow the heelpiece to move back automatically as the blocking device moves into the brake blocking configuration.

10. Braking device according to claim 9, wherein the attachment element is a toothset to allow adjustable longitudinal positioning of the heelpiece.

11. Braking device according to claim 1, wherein the braking device comprises an actuating element for manual actuation of the blocking device.

12. Heelpiece and braking device assembly for attaching the rear part of a ski boot to a touring ski, wherein the heelpiece is connected to the braking device according to claim 1.

13. Heelpiece and braking device assembly according to claim 12, wherein the heelpiece is attached to the blocking device in such a way as to achieve automatic backward movement of the heelpiece as the braking device passes into its brake blocking configuration.

14. Alpine touring ski, which comprises a braking device according to claim 1 and a heelpiece and braking device assembly for attaching the rear part of a ski boot to a touring ski, wherein the heelpiece is connected to the braking device according to claim 1.

15. Braking device for a touring ski comprising a brake and a blocking device able to occupy a blocking configuration in which the brake is immobilized by the blocking device in the position of non-braking and a non-blocking configuration in which the brake is able to brake the ski in a braking position, wherein the blocking device is mounted with the ability to move in sliding with respect to the brake so as to occupy the blocking configuration or non-blocking configuration, and wherein the blocking device comprises:

an attachment element for a heelpiece of a ski binding to allow the heelpiece to move back automatically as the blocking device passes into the brake blocking configuration; and a link rod having a blocking element able to block the brake and an actuating element for sliding the link rod and the blocking element.

16. Braking device for a touring ski according to the claim 15, wherein the blocking element of the blocking device acts directly on the elastic element of the brake during actuation of the blocking device, irrespective of the initial position of the brake, applying a dynamic effect of positioning the brake in the non-braking position as the blocking device moves towards the blocking configuration.

17. Braking device according to claim 15, wherein the blocking device is independent of the brake.

18. Braking device according to claim 15, wherein the brake is fixed to a ski and in that the blocking device is able to slide with respect to the brake.

19. Braking device according to claim 15, wherein the blocking element acts directly on the elastic element of the brake during actuation of the blocking device and/or when the braking device is occupying its blocking configuration.

20. Braking device according to claim 15, wherein the blocking device comprises a blocking element which comprises a groove that allows the brake to be blocked.

21. Braking device according to claim 15, wherein the blocking device comprises a blocking element which comprises a stop piece that allows the brake to be blocked.

22. Braking device according to claim 15, wherein the link rod comprises a bow for locking the blocking device in the non-blocking configuration, unlocking being obtained through a lever-type elastic effect of the link rod by applying a force to the actuating element.

23. Braking device according to claim 15, wherein the attachment element is a toothset to allow adjustable longitudinal positioning of the heelpiece.

24. Braking device according to claim 15, wherein the braking device comprises an actuating element for manual actuation of the blocking device.

25. Braking device for a touring ski comprising a brake, comprising:

an elastic element which applies an elastic return force returning braking branches to the braking position of the brake; and a blocking device able to occupy a blocking configuration in which the brake is immobilized by the blocking device in the position of non-braking and a non-blocking configuration in which the brake is able to brake the ski in a braking position, the blocking device is mounted with the ability to move in sliding with respect to the brake so as to occupy the blocking configuration or non-blocking configuration, and wherein the blocking device comprises:

a blocking element which acts on the brake during actuation of the blocking device by applying a first effect of positioning the brake in the non-braking position which opposes the elastic return force; and an attachment element for a heelpiece of a ski binding to allow the heelpiece to move back automatically as the blocking device moves into the brake blocking configuration.

26. Braking device according to claim 25, wherein the attachment element is a toothset to allow adjustable longitudinal positioning of the heelpiece.

* * * * *